US006505632B1

(12) United States Patent
Toll et al.

(10) Patent No.: US 6,505,632 B1
(45) Date of Patent: Jan. 14, 2003

(54) MASCARA APPLICATOR HAVING T-SHAPED APPLICATOR WAND AND CONTAINER THEREFOR

(75) Inventors: Charlotte Toll, Beverly Hills, CA (US); Kenneth R. Jones, Wayne, NJ (US)

(73) Assignee: Charbelle Ltd., Los Angeles, CA (US)

( * ) Notice: Subject to any disclaimer, the term of this patent is extended or adjusted under 35 U.S.C. 154(b) by 0 days.

(21) Appl. No.: 09/934,566

(22) Filed: Aug. 23, 2001

(51) Int. Cl.[7] ..... A45D 40/26; A46B 11/00

(52) U.S. Cl. ..... 132/218; 132/320; 401/122; 401/129

(58) Field of Search ..... 132/218, 320, 132/216, 317; 401/122, 129, 126, 121, 127

(56) References Cited

U.S. PATENT DOCUMENTS 3,653,530 A * 4/1972 Winfrey ..... 132/73
3,760,820 A * 9/1973 Seidler ..... 132/218
3,764,221 A * 10/1973 Solenghi ..... 401/129
5,188,131 A * 2/1993 Toll ..... 132/218

* cited by examiner

*Primary Examiner*—John J. Wilson
*Assistant Examiner*—Robyn Kieu Doan
(74) *Attorney, Agent, or Firm*—Burns, Doane, Swecker & Mathis, LLP

(57) ABSTRACT

A mascara applicator includes an applicator wand and a container therefor. The wand includes a handle, a stem extending from the handle, and a brush attached to the stem and extending transversely relative to the stem. The container forms an internal chamber which contains mascara and in which the stem and brush can be inserted. The container forms a channel extending perpendicular to an axis of the stem for enabling the brush to be inserted into or removed from the container. The handle includes a sealing lug which seals across the channel when the applicator wand is installed in the container. To remove the wand, the wand is moved in a first direction parallel to the stem axis to bring the brush into alignment with the channel; then the wand is moved in a second direction perpendicular to the stem axis to move the brush through the channel.

16 Claims, 4 Drawing Sheets

MASCARA APPLICATOR HAVING T-SHAPED APPLICATOR WAND AND CONTAINER THEREFOR

BACKGROUND OF THE INVENTION

The present invention relates to mascara applicators and, in particular, to an applicator comprising a T-shaped applicator wand and a container therefor.

A T-shaped mascara applicator wand (T-wand) and a container therefor are disclosed in U.S. Pat. Nos. 5,188,131; 5,309,929; and 5,556,214. The wand comprises a stem and an applicator brush extending transversely of the stem. The container is of elongated (oval) cross-sectional shape for containing the mascara. A handle of the applicator wand also serves as a cover for the container.

It is desirable to produce an air-tight seal between the container and the cover in order to resist the evaporation of ethanol from the mascara and the resulting drying-out of the mascara. In the case of an in-line wand, i.e., wherein the applicator brush and the wand stem are colinear, the cover can be provided with a screw thread to enable the cover to be screwed onto the container. The screw threads perform a camming action forcing the cover against a wiper disposed in the container to enable a proper air-tight seal to be produced.

In the case of the T-wand and container described in the abovementioned patents, however, there is insufficient space within the container to allow the brush to rotate about the axis of the stem. Thus, it is not possible to attach the cover to the container by a screw thread unless the cover were made rotatable relative to the wand. That would, however, make it difficult to use the cover as a handle when applying the mascara, because the brush would tend to rotate out of its desired orientation during the application process.

Also, the opening formed in the container for allowing the T-wand to be inserted and removed in a direction parallel to the stem axis must be relatively large, making it somewhat difficult to seal the container and to wipe excess mascara from the brush.

It would be desirable, therefore, to provide a mascara container for a T-wand which enables an air-tight seal to be established, and enables excess mascara to be effectively wiped from the brush during brush withdrawal.

SUMMARY OF THE INVENTION

The present invention relates to a mascara applicator which comprises an applicator wand that includes a handle, a stem extending from the handle, and a brush attached to a free end of the stem. The brush extends transversely relative to the stem. The stem defines a longitudinal axis. The applicator also includes a container forming an internal chamber which contains mascara. The container includes an upper face having a hole formed therein for receiving the stem. The container also includes a channel spaced downwardly from the upper face and extending transversely of the hole. The channel intersects a side wall of the container to define an external access opening. An inner end of the channel defines an internal access opening. The wand is removable from the container by a dual-direction movement comprising a first direction parallel to the axis to bring the brush into alignment with the internal access opening, and a second direction transversely of the axis to move the wand through the channel.

Preferably, the wand includes a wiper seal which extends generally parallel to the axis and is arranged to seal across the internal access opening when the wand is disposed within the container.

The applicator preferably further includes a seal disposed on the top face and formed of an elastically flexible material. The seal forms a seal across an upper portion of the channel and permits travel of the wand in the transverse direction.

BRIEF DESCRIPTION OF THE DRAWINGS

The objects and advantages of the invention will become apparent from the following detailed description of a preferred embodiment thereof in connection with the accompanying drawings in which like numerals designate like elements and in which.

DETAILED DESCRIPTION OF A PREFERRED EMBODIMENT OF THE INVENTION

Figure 1:
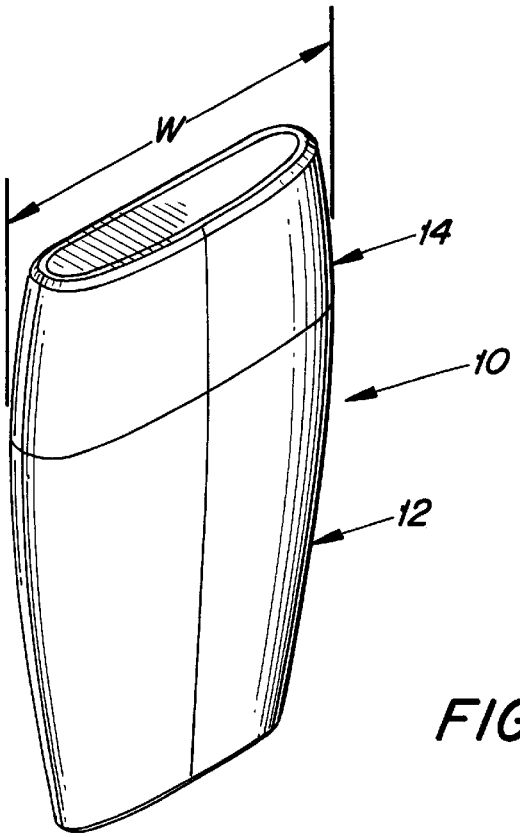
FIG. 1 is a top perspective view of a mascara applicator with an applicator wand mounted within a container of the applicator.

A mascara applicator 10 includes a container 12 and an applicator wand 14 removably disposed therein.

The container 12 includes a base body 15 and a collar 16 attached to the base body (e.g., by welding). The base body 15 forms a chamber 18 therein which contains a supply of mascara (not shown). The container is of elongated cross section in that a maximum width W thereof is greater than a maximum thickness T thereof. The chamber 18 is bordered by two opposing side walls 21, 22 of the base body 15, and a pair of gussets 20 which extend between those side walls.

The collar 16 includes a main section 24 and a sealing plate 26 mounted thereon. The main section 24 is formed of a stiff plastic material, such as nylon, polypropylene, polythylene, etc., whereas the sealing plate 26 is formed of a flexible plastic material, such as a thermoplastic elastomer (TPE) or rubber. The bottom of the main section 24 is open and defined by a rim 28. That rim 28 fits into an open upper end of the base body 15 and rests upon a seating shoulder 30 of the base body which is spaced downwardly from an upper rim 32 of the base body.

The sealing plate 26 is integrally molded to the main section 24 of the collar, so as to be disposed in a top wall 34 of the main section 24. A top wall 36 of the sealing plate 26 is flush with the top wall 34 of the main section 24 and forms therewith a top face of the container 12. The sealing plate 26 forms a central hole 40 that defines a center axis A of the container 12. A slit 42 extends laterally through the sealing plate 26 from the hole 40 to an end of the sealing plate 26 for reasons to be explained. Formed in the slit 42 and situated intermediate the opposite ends of the slit is an upwardly open first recess 44.

The main section 24 forms a channel 50 situated beneath the slit 42 and extending parallel to the slit from the hole 40 to a side of the main section 24 to form there an external access opening 52 of the channel. An inner access opening 54 of the channel (see FIG. 5) is of smaller diameter than the external opening 52. The channel 50 is of circular cross sectional shape, and tapers (narrows) inwardly, i.e., in a direction from the outer opening 54 to the inner opening 52. The external access opening 52 flares outwardly to facilitate the entry of a brush of the applicator wand 14, as will become apparent.

Figure 8:
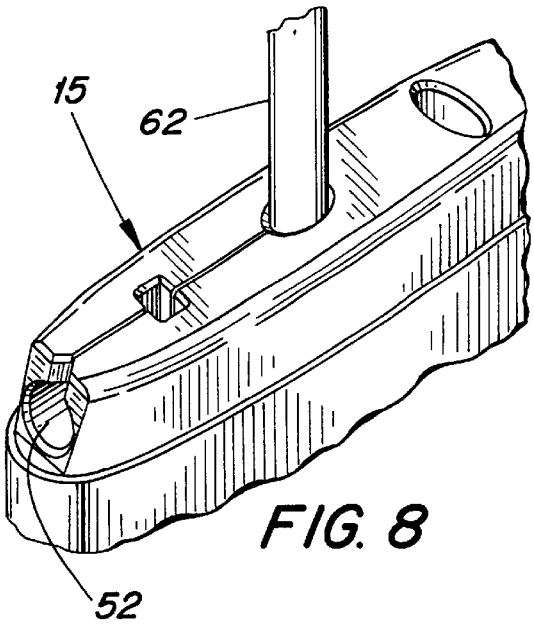
FIG. 8 is an enlarged to perspective view of a portion of the container with the applicator wand mounted therein.
Figure 10:
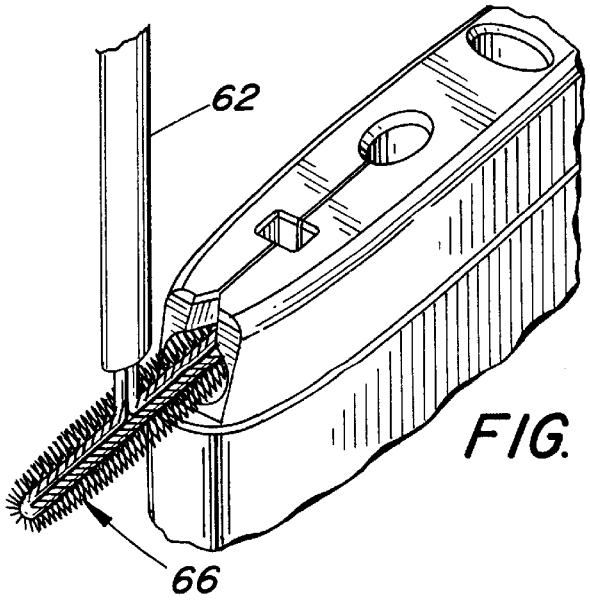
FIG. 10 is a view similar to FIG. 7 after the applicator has been substantially removed from the container.

The channel 50 communicates with the slit 42 via a slot 55 which has a width that is shorter than a maximum diameter of the channel 50 (see FIGS. 8 and 10).

Formed in the top wall 34 is a second upwardly open recess 58, which is spaced from the hole 40 in a direction opposite the first recess 44.

Figure 3:
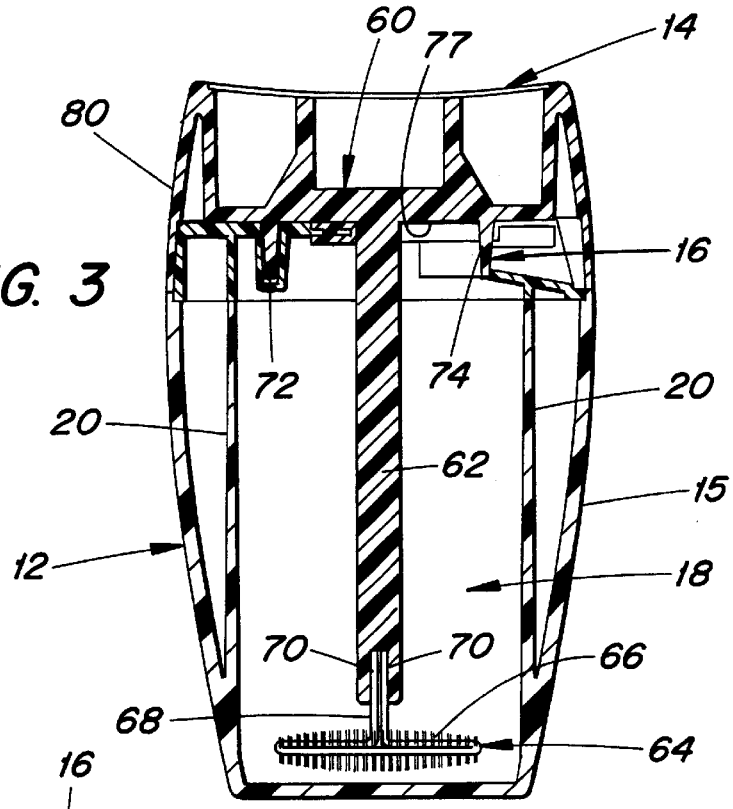
FIG. 3 is a vertical sectional view taken through FIG. 1.
Figure 4:
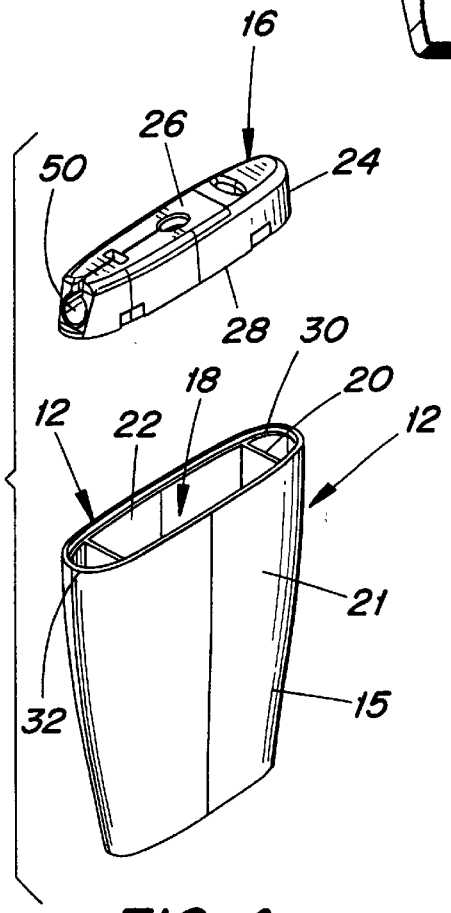
FIG. 4 is an exploded top perspective view of the container.

The mascara applicator wand 14 includes a manually grippable handle 60 and a stem 62 which can be integrally molded of the same material as the container base body 15. The handle 60 also serves as a cover for the container 12. Mounted at a free end of the stem is a brush 64 which extends transversely, preferably perpendicularly, relative to the stem, wherein a center axis of the stem intersects a midpoint of the brush. The brush can be of any suitable shape such as cylindrical or wavy, or brush bristles 66 can be longer near the brush midpoint than at the brush ends, i.e., the brush diameter tapers from a maximum at the midpoint to a minimum at the ends as shown in FIG. 3. The bristles 66 can be mounted to the stem in any suitable fashion, such as by being mounted in a wire 68 that is bent to form two vertical mounting end portions 70 affixed within the stem. Portions of those end portions project downwardly beyond a lower end of the stem 62 for a reason to be explained.

Projecting downwardly from the handle 60 parallel to the stem 62 are two lugs 72, 74 of identical construction each of which is capable of functioning as a seal. That is, when the wand 14 is installed in the container as shown in FIG. 3, wherein a bottom rim 71 of the handle 60 is seated on the upper rim 32 of the container, one of the lugs, e.g., lug 74 passes through the first recess 44 of the collar 16 and seats against and across the inner opening 54 of the channel 50 to prevent leakage of mascara. The other lug 72 is received in the second recess 58, which is a blind recess provided merely to accommodate the lug 72. That is, the wand is reversible in that either of the lugs 72, 74 can be inserted through the first recess 44.

Figure 2:
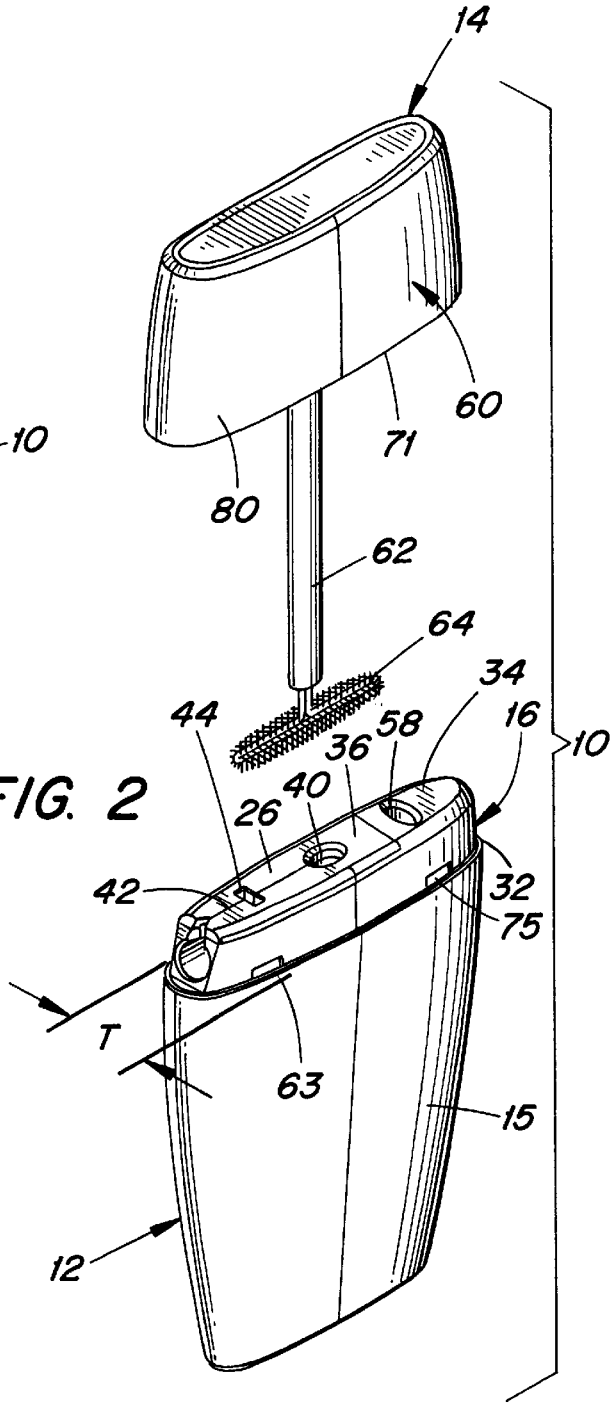
FIG. 2 is a view similar to FIG. 1 showing the wand and the container in an exploded condition.
Figure 6:
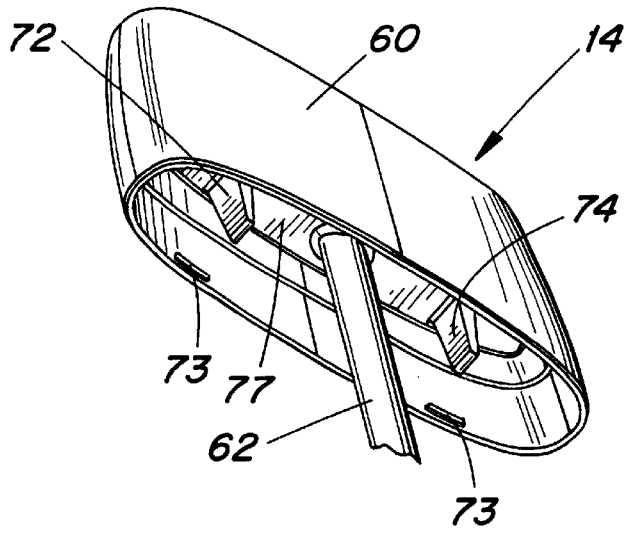
FIG. 6 is a bottom perspective view of a handle portion of the applicator wand.

The wand 14 can be releasably attached to the container in any suitable way. For example, the inside surface of the handle 60 could be provided with inwardly projecting tabs 73 (FIG. 6) that snap into respective pockets 75 formed in an outer surface of the collar 16 (FIG. 2) when the want is inserted onto the container.

The handle 60 also includes a downwardly facing inside surface 77 which presses against the top wall 34 when the wand 14 is inserted onto the container, to seal the hole 40 and the slit 42.

Figure 7:
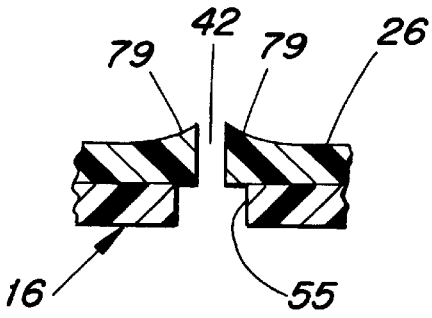
FIG. 7 is a cross sectional view through a slit formed by a sealing plate, when the handle of the wand is not pressed thereagainst.
Figure 7A:
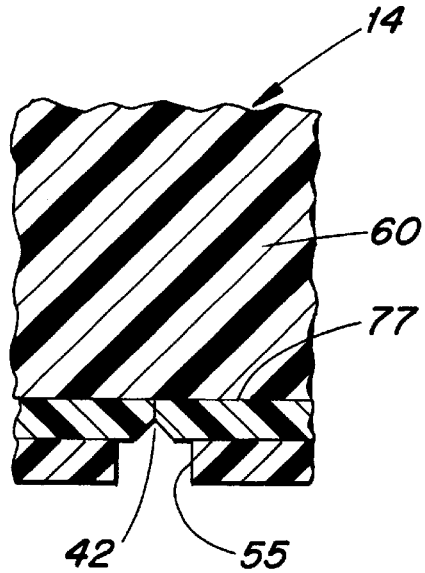
FIG. 7A is a view similar to FIG. 7 when the handle is pressed against the sealing plate.

The sealing plate 26 could be provided with an upstanding ridge 79 extending along each side of the slit 42, as shown in FIG. 7. When the wand 14 is inserted into the container, the surface 77 presses against the ridges to deform them into mutual contact, thus effectively closing the slit 42. If desired, the ridges could be extended to extend around the hole 40 to be pressed against the stem 62 when the wand is inserted.

Figure 5A:
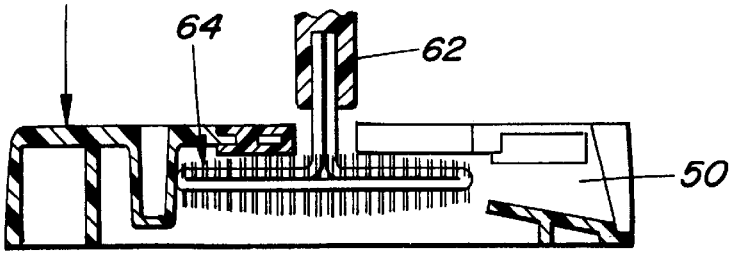
FIG. 5 is an enlarged vertical sectional view taken through a collar of the container.
Figure 5:
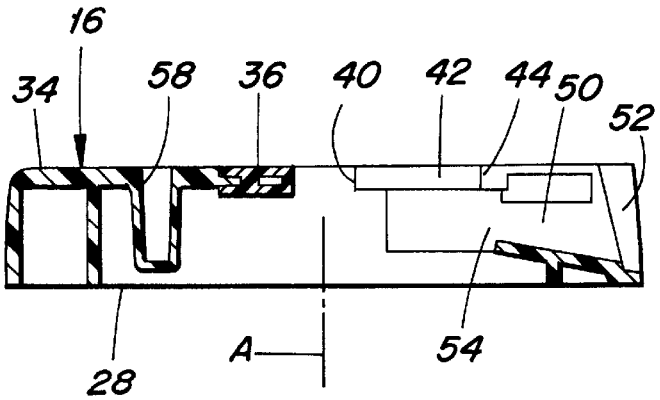
Figure 9:
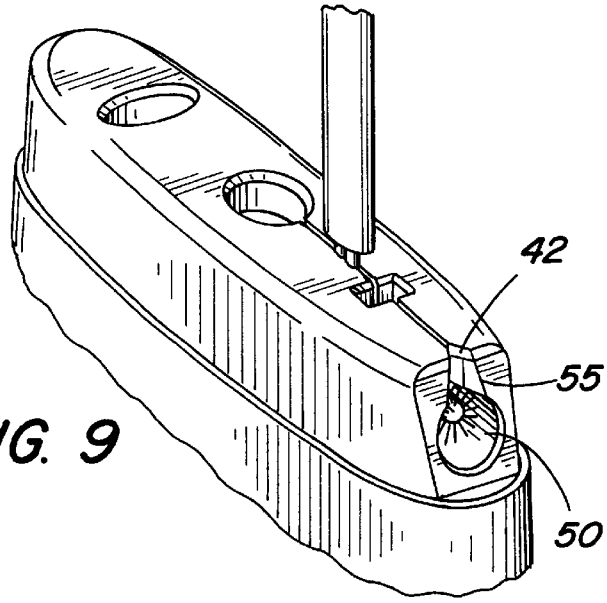
FIG. 9 is a view similar to FIG. 6 as the applicator wand is in the process of being moved out of the container.

Depicted in FIG. 8 is an upper end of the container 15 showing the stem 62 extending through the center hole 40. FIG. 9 shows the condition where the stem 62 has been pulled upwardly (i.e., in a direction parallel to the stem axis), resulting in the brush 64 becoming aligned with the inside opening 54 of the channel, as shown in FIG. 5A, and with the exposed portions of the wire 68 projecting through the hole 40. That enables the applicator wand 14 to be moved transversely out of the container, because the diameter of the wire 68 is smaller than the width of the slot 55, and because the seal plate 26 flexes as the wire 68 passes through the slit 42 (i.e., the opposing edges of the slit 42 are forced elastically away from one another by the wire 68). As the brush passes through the interior opening 54, the edge of that opening wipes excess mascara from the brush, because the diameter of the interior opening 54 is slightly smaller than the minimum diameter of the brush. FIG. 10 depicts the wiped brush exiting the channel.

Reinsertion of the wand is performed by reversing the above steps, i.e., inserting the brush through the channel 50 and then pushing the wand axially downwardly until the handle is pressed into closing engagement with the upper portion of the container. Whichever of the lugs 72, 74 passes through the first recess 44 will seal against and across the interior opening 54 of the channel 50.

It will be appreciated that the present invention solves the problems associated with a T-shaped applicator wand, i.e., sealing the container from mascara leakage and wiping mascara from the brush, by establishing a dual-direction travel of the wand, i.e., in a direction parallel to the stem axis and a direction transversely of the stem axis.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A mascara applicator comprising:

an applicator wand including a handle, a stem extending from the handle, and a brush attached to a free end of the stem and extending transversely relative to the stem, the stem defining a longitudinal axis; and a container forming an internal chamber containing mascara, the container including an upper face having a hole formed therein for receiving the stem and a channel spaced downwardly from the upper face and extending transversely relative to the hole, the channel intersecting a side wall of the container to define an external access opening, an inner end of the channel defining an internal access opening;

the wand being removable from the container by a dual-direction movement comprising a first direction parallel to the stem axis to bring the brush into alignment with the internal access opening, and a second direction transversely of the stem axis to move the wand through the channel.

2. The mascara applicator according to claim 1 further including a first seal element disposed on the wand and arranged to seal against and across the internal access opening when the wand is installed in the container.

3. The mascara applicator according to claim 2 wherein the first seal element extends parallel to the stem axis.

4. The mascara applicator according to claim 2 further including a second seal element disposed on the top face of the container and formed of an elastically flexible material, the second seal element forming a seal along an upper portion of the channel and permitting passage of the brush through the channel.

5. The mascara applicator according to claim 1 further including a seal element disposed on the top face of the container and formed of an elastically flexible material, the seal element forming a seal along an upper portion of the channel and permitting passage of the brush through the channel.

6. The mascara applicator according to claim 1 wherein the internal access opening is of smaller diameter than a minimum diameter of the brush.

7. A mascara applicator comprising:

an applicator wand including a handle, a stem extending from the handle, and a brush attached to a free end of the stem and extending transversely relative to the stem, the stem defining a longitudinal axis; and a container forming an internal chamber containing mascara, the container including:

a hole extending through an upper face of the container and receiving the stem, a channel extending laterally with respect to the hole, an inner end of the channel defining an internal access opening communicating with the chamber, an outer end of the channel extending through a side wall of the container to define an external access opening, and a first seal element formed of an elastically flexible material and overlying an upper portion of the channel, the first seal element including a slit extending from the hole to the side wall, the slit extending across and parallel to the channel;

the applicator wand including a second seal element arranged to seal against and across the internal access opening when the applicator wand is installed on the container;

the wand being removable from the container by moving the wand parallel to the axis to bring the brush into alignment with the internal access opening, and then moving the wand transversely of the axis to move the brush through the channel.

8. The mascara applicator according to claim 7 wherein the channel communicates with the slit by a slot formed in the container.

9. The mascara applicator according to claim 8 wherein the brush comprises bristles attached to a wire, the wire attached to the stem, the wire arranged to pass through the slot and the slit during movement of the wand into and from the container.

10. The mascara applicator according to claim 7 wherein the second seal element comprises a lug projecting from the handle, the upper face including a recess for receiving the lug.

11. The mascara applicator according to claim 7 wherein there are two of the lugs formed on the handle, the upper face including two recesses for receiving respective ones of the lugs, one of the recesses overlying the internal access opening and extending completely through the upper face, the other recess being a blind recess.

12. The mascara applicator according to claim 11 wherein the first seal element comprises a seal pate, with the hole, the slit and the first recess being formed in the seal plate.

13. The mascara applicator according to claim 12 wherein the seal plate is integrally molded to a base body of the container.

14. The mascara applicator according to claim 7 wherein the channel tapers from the external access opening to the internal access opening.

15. The mascara applicator according to claim 7 wherein the first seal element includes first and second ridges extending along respective first and second sides of the slit, the handle including a surface arranged to press the first and second ridges into mutual sealing engagement when the want is inserted into the container.

16. A mascara applicator comprising:

an applicator wand including a handle, a stem extending from the handle, and a brush attached to a free end of the stem and extending perpendicularly relative to the stem, the brush attached to a wire mounted in the stem, a portion of the wire projecting downwardly from the stem, the stem defining a longitudinal axis; and a container forming an internal chamber containing mascara, the container including:

a body forming:

hole extending through an upper face of the container body and receiving the stem, a channel spaced downwardly from the upper face and extending perpendicularly relative to the hole, an inner end of the channel defining an internal access opening, an outer end of the channel extending through a side wall of the container body to define an external access opening; and a slot extending along an upper portion of the channel and communicating with the upper face, a seal plate formed of an elastically flexible material and attached to the container body, the seal plate including a slit overlying the slot and extending therealong, the hole formed in the seal plate, the slit extending from the hole to the side wall of the body, a recess formed in the seal plate and situated intermediate opposite ends of the slit, the handle including a downwardly projecting lug arranged to extend through the recess into sealing relationship against and across the internal access opening of the channel when the wand is installed within the container;

the wand being removable from the container by moving the wand parallel to the axis to bring the brush into alignment with the internal access opening and then moving the wand transversely of the axis to move the brush outwardly through the channel.

* * * * *